US005343573A

United States Patent [19]

Rose et al.

[11] Patent Number: 5,343,573

[45] Date of Patent: Sep. 6, 1994

[54] INTEGRALLY MOLDED STACKABLE COMMODE CHAIR

[75] Inventors: Eric P. Rose, Van Nuys; Stuart Karten, Marina Del Rey; Alfredo Nuno, Glendale, all of Calif.

[73] Assignee: Guardian Products Inc., Simi Valley, Calif.

[21] Appl. No.: 945,725

[22] Filed: Sep. 16, 1992

[51] Int. Cl.[5] ..... A47K 11/04

[52] U.S. Cl. ..... 4/449; 4/483; 4/484

[58] Field of Search ..... 4/449, 461, 483, 484, 4/460; 297/239, 419, 420; 248/188.2, 188.5, 188.6

[56] References Cited

U.S. PATENT DOCUMENTS

| | | | |
|---|---|---|---|
| D. 284,718 | 7/1986 | Massonnet . | |
| D. 287,673 | 1/1987 | Verschuren . | |
| D. 295,588 | 5/1988 | Heitlinger et al. . | |
| D. 296,395 | 6/1999 | Polacsek . | |
| D. 313,515 | 1/1991 | Wood . | |
| 577,136 | 2/1897 | Honeywell . | |
| 784,950 | 7/1904 | Lindsay . | |
| 1,017,675 | 2/1912 | King . | |
| 1,408,114 | 2/1922 | Mathieu . | |
| 1,508,888 | 9/1922 | Klatt . | |
| 1,849,835 | 1/1930 | Jantzen et al. . | |
| 1,947,373 | 5/1931 | Bickel . | |
| 2,146,206 | 2/1939 | Elliot | 4/483 |
| 2,262,204 | 11/1941 | Rideout . | |
| 2,461,160 | 8/1947 | Joyce . | |
| 2,649,147 | 8/1953 | Sanford | 297/419 |
| 2,662,229 | 12/1953 | Wenkstern . | |
| 2,677,414 | 5/1954 | Abramovitz | 297/420 |
| 2,750,709 | 6/1956 | Saverino | 248/188.2 |
| 2,820,969 | 1/1958 | Wedge . | |
| 2,936,826 | 5/1960 | Reineman . | |
| 3,078,470 | 9/1961 | Rosenfeld . | |
| 3,107,360 | 10/1963 | Van Syoc, Sr. et al. | 4/484 |
| 3,173,723 | 3/1965 | Hoven et al. . | |
| 3,215,469 | 11/1965 | Wamsley . | |
| 3,258,291 | 6/1966 | Ezquerra . | |
| 3,343,179 | 9/1967 | Sellars, Jr. et al. . | |
| 3,364,478 | 1/1968 | Dee Waard | 4/483 |
| 3,391,408 | 7/1968 | Anderson . | |
| 3,568,219 | 3/1971 | Roberts | 4/483 |
| 3,601,822 | 8/1971 | Weiss . | |
| 3,637,256 | 1/1972 | Harty . | |
| 3,716,872 | 2/1973 | Zieman . | |
| 3,795,923 | 3/1974 | Thomas . | |
| 3,829,908 | 8/1974 | Thomas . | |
| 3,854,773 | 12/1974 | Thomas . | |
| 3,874,726 | 4/1975 | Sebel et al. . | |
| 3,905,051 | 9/1975 | Gozdziewski . | |
| 3,959,833 | 6/1976 | Burke . | |
| 4,002,369 | 1/1977 | Jennings . | |
| 4,199,826 | 4/1980 | Devereux . | |
| 4,287,619 | 9/1981 | Brewer et al. . | |
| 4,341,419 | 7/1982 | Sebel . | |
| 4,457,029 | 7/1984 | Matthews . | |
| 4,469,377 | 9/1984 | O'Rourke . | |
| 4,550,455 | 11/1985 | Carson et al. . | |
| 4,592,097 | 6/1986 | Zimmerman . | |
| 4,680,816 | 7/1987 | Colombani . | |
| 4,777,672 | 10/1988 | Gebhard et al. . | |
| 4,823,412 | 4/1989 | Spiegel . | |
| 4,856,845 | 8/1989 | Massonnet . | |
| 5,044,691 | 9/1991 | Guichon . | |
| 5,060,896 | 10/1991 | Hobbins . | |
| 5,068,927 | 12/1991 | Massaro . | |
| 5,123,126 | 6/1992 | Vincent . | |
| 5,197,152 | 3/1993 | Rose et al. | 4/483 |

FOREIGN PATENT DOCUMENTS

| | | |
|---|---|---|
| 1529443 | 5/1969 | Fed. Rep. of Germany . |
| 2084458 | 4/1982 | United Kingdom . |

*Primary Examiner*—Henry J. Recla
*Assistant Examiner*—Charles R. Eloshway
*Attorney, Agent, or Firm*—Willian Brinks Hofer Gilson & Lione

[57] ABSTRACT

An integrally molded unitary stackable commode chair comprises a seat with a central opening, four legs, a back rest, and two armrests that have a greater vertical elevation at the chair front than at the rear. The seat comprises subjacent ribs to provide strength and durability. The seat also has a slightly resilient transition zone that partially borders the central opening and is free from subjacent ribs and gussets.

38 Claims, 6 Drawing Sheets

INTEGRALLY MOLDED STACKABLE COMMODE CHAIR

BACKGROUND OF THE INVENTION

This invention relates to a stackable commode chair that is comfortable for the user and that can be used by hospital patients, disabled persons, invalids, and elderly persons. More particularly, the invention is directed to an integrally molded unitary stackable commode chair that is made of lightweight plastic yet is durable, safe, and easily stacked for storage and shipping.

The special needs of disabled and elderly persons for a safe, durable, comfortable and convenient toilet seating apparatus or commode chair have been known for a long time. In particular, typically the person who is going to use the chair is helped to the seat or is in a weakened condition, thus it is not unusual for that person to be dropped or to drop onto the seat. Thus, the seat of the commode chair must be able to withstand the repetitive stress caused by such dropping forces without breaking.

At the same time, it is well known that disabled and elderly persons may be required to sit in the commode chair for extended periods of time because they are not well attended or for physical reasons such as constipation and the like. Thus, the chair seat should also be somewhat resilient and designed for comfort. Existing commode chairs, however, are not comfortable when the person must sit on the chair for an extended period of time because most of the body weight is typically supported under the ischial tuberosities when seated.

Many commode chairs previously known have been designed with side arms or support rails which swing away from the seat or drop downwardly. In such devices, the arms are unstable and may cause the person to feel insecure due to the excessive wobble in the armrests. Any instability or insecurity is not only dangerous to, but also produces considerable discomfort for, the invalid, disabled or elderly person who is using the device.

Accordingly, the chair should provide a feeling of stability yet be easy to use. The design should enable the person using the chair to easily sit on the chair and to get up from it. Thus, the armrests which are used for support during these actions should be designed to accommodate the user in this regard as well.

Undoubtedly the chair will become soiled with fecal matter particularly because the individuals using such chairs may be incontinent. Unfortunately, an additional shortcoming of many existing commode chairs is that they are difficult to clean and maintain in a sanitary condition because they consist of many small parts, crevices and contain metal parts that can rust and become very difficult to clean.

Accordingly, a chair which solves these problems yet is easily manufactured and shipped is desired. Due to transportation cost reasons, it is desirable to ship as many commode chairs in a single load as possible. Thus, the commode chairs should be stackable such that two or more chairs can be stacked, one on top of another, to produce as small a height as possible.

SUMMARY OF THE INVENTION

The present invention comprises an unitary integrally molded stackable commode chair. In one embodiment, the chair comprises a generally horizontal seat with a front, a first and a second lateral side, a central opening, and a rear that terminates in a substantially vertical backrest which extends upward. Preferably, the seat has a front section that is advantageously curved downward in part and upward in part to conform to the upper legs of the human anatomy in a seating position and a front edge that is tapered or curved downward.

The front of the seat has two front legs that extend downward and are shaped substantially as angles open on the sides and toward the front. Each leg comprises a flat flange and a crowned or curved flange. Each flat flange lies in substantially the same plane as the lateral side of the seat and the curved flange lies at a substantially right angle to the flat flange. The rear of the seat has two rear legs that extend downward and are shaped substantially as angles open on the sides and toward the rear and comprise a flat flange and a crowned or curved flange. The flat flange lies in a plane substantially parallel to the plane of the lateral side of the seat and the curved flange lies at a substantially right angle to the flat flange.

The chair also has armrests integrally formed with the seat and front legs at one end and with the backrest at the other end so that the armrests join each of the two front legs to the backrest. Desirably, the armrests are inclined downwardly toward the rear of the chair such that the vertical elevation of the armrests is greater at the front of the chair than at the rear. This armrest construction enables a person to enter and exit the chair more easily with a minimum amount of knee flexion.

The underside of the seat has a plurality of ribs comprising at least one front rib adjacent and substantially parallel to the front of the seat and joining the two front legs; at least one lateral rib adjacent and substantially parallel to the first lateral side and extending from the front of the seat to the rear leg; at least one lateral rib adjacent and substantially parallel to the second lateral side and extending from the front of the seat to the rear leg; and at least one rear rib adjacent and substantially parallel to the rear of the seat and joining the two rear legs.

Preferably, a plurality of gussets that intersect the ribs are provided. Where gussets are provided, at least one gusset is provided to intersect the front rib and at least one gusset is provided to intersect each lateral rib.

The seat further has a slightly resilient transition zone partially bordering the central opening and being free from subjacent ribs and gussets such that the seat is able to withstand an impact force of 225 pound, at a height from about 5 to about 16 inches.

In one embodiment, rails are integrally molded on the underside of the seat parallel to the lateral sides. In this embodiment, the rails are located on both sides of and adjacent to the central opening. A slidably removable commode bucket having a rim with a perimeter opening conforming to the shape of the central opening extends downwardly and is supported by the rails. The bucket may have a handle so that a person may, using only one hand, slidably remove the bucket and empty it.

In another embodiment, the underside of the seat is provided with two lines of bosses each aligned parallel to the lateral sides and located on either side of the central opening. In this embodiment, rails having openings are provided to engage the bosses and thus provide a support for the removable commode bucket.

The commode chair of the present invention may also be provided with chair leg extensions for the chair legs to permit the height of the chair to be adjusted. This feature allows the chair to be adjusted to the size and height of the individual user as well as to existing toilet facilities when the chair is used in conjunction with those toilet facilities.

DETAILED DESCRIPTION OF THE PREFERRED EMBODIMENTS

Figure 1:
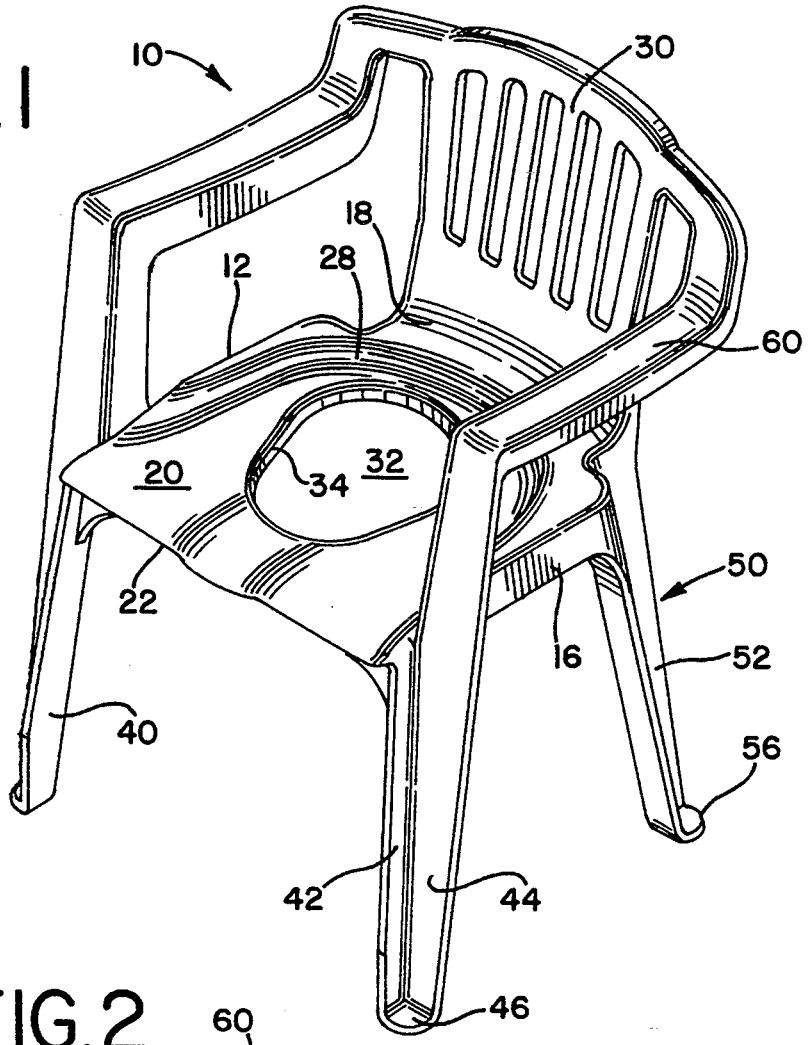
FIG. 1 is a front perspective view of one embodiment of the stackable commode chair.

In a first embodiment of the invention, shown in FIGS. 1–5, the integrally molded stackable chair 10 comprises a seat 12 with a central opening 32, a backrest 30, a pair of front legs 40, a pair of rear legs 50, and armrests 60. The chair is preferably integrally molded as one piece from plastic. A suitable plastic material for molding the chair 10 is calcium carbonate filled polypropylene.

The seat 12 has a first lateral side 14, a second lateral side 16, and a rear 18 from which the backrest 30 extends substantially vertically upward. Preferably, the first side 14 and second side 16 extend downwardly from the upper side 24 of the seat 12. The seat 12 is substantially horizontal with a front section 20 that is preferably but not necessarily angled downward toward a downwardly tapered front edge 22. Preferably, the front section 20 is angled downward from the horizontal about 10 degrees.

The seat 12 also has an upper side 24 for sitting and an underside 26. The upper side 24 of the seat 12 is sculpted to conform to the human anatomy in the seated position. The sculpting of the seat 12 can include configuring the seat 12 such that the front edge 22 of the seat is tapered downward so that the upper legs of the person sitting in the chair rest on the downwardly tapered part of the seat.

The seat 12 can also be sculpted and contoured to ensure contact with as much support surface as possible, including around the back of the buttocks and the outside of the thighs. For example, the seat 12 can be advantageously raised around the back and the sides to provide an upwardly curved section 28 of the seat 12 with the contouring extending forward along the length of the thigh where it is slightly concave to provide maximum thigh support. To ensure that excess pressure is not exerted under the thighs and that the load is evenly distributed over the entire contoured contact surface, the front section 20 of the seat 12 can be contoured such that it is curved downward in part and upward in part to conform to the upper legs of the person seated in the chair.

The seat 12 has a central opening 32, preferably a large, pear or egg-shaped opening with a downwardly extending lip 34 located about the periphery. The egg-shaped opening is wider in the rear and is longer than in common toilet seats to minimize the possibility of waste soiling the seat.

As best seen in FIG. 1, a pair of front legs 40 are integrally formed with the seat 12 and armrests 60 and extend downward from the front of the seat 12. Each leg 40 is shaped substantially as an angle open on the sides and toward the front which terminate in a flat foot 46 that rests on the floor. Each leg 40 comprises a flat flange 42 and a crown or curved flange 44. Each flat flange 42 lies generally in the same plane as each respective lateral side 14 and 16 of the seat 12. Preferably, each flat flange 42 is coextensive with its respective lateral side 14 and 16. Thus, the flat flange 42 faces outwardly from the chair 10. The crown or curved flange 44 is at a generally right angle to the flat flange 42 and thus faces forwardly of the chair 10.

A pair of rear legs 50 are integrally formed with the seat 12 and extend downward from the rear of the seat 12. Each leg 50 is shaped substantially as an angle open on the sides and toward the rear that terminate in a flat foot 56 that rests on the floor. Each leg 50 comprises a flat flange 52 and a crown or curved flange 54. Each flat flange 52 lies substantially in a plane parallel to the plane of the lateral sides 14 and 16 of the seat 12. Thus, the flat flange 52 faces outwardly from the chair 10. The crown or curved flange 54 is at a generally right angle to the flat flange 52 and thus faces-rearwardly of the chair 10. It is thought that the curved flanges 44 and 54 aid in preventing buckling of the legs under the stress of stacking and the impact of an user's weight.

The legs 40 and 50 at their upper portion are angled from the vertical. The legs, however, at their lower portion are angled to a more vertical position to increase the stability of the chair when a user sits on it. The underside of the feet 46 and 56 can be provided with a recess to receive a bumper made of rubber or like material. When the bumper is inserted into the recess, sliding of the chair on smooth and wet surfaces such as tile floors, shower stalls and the like is minimized. Preferably, one side of the bumper is provided with an adhesive so that it is more securely engaged to the feet.

Figure 7:
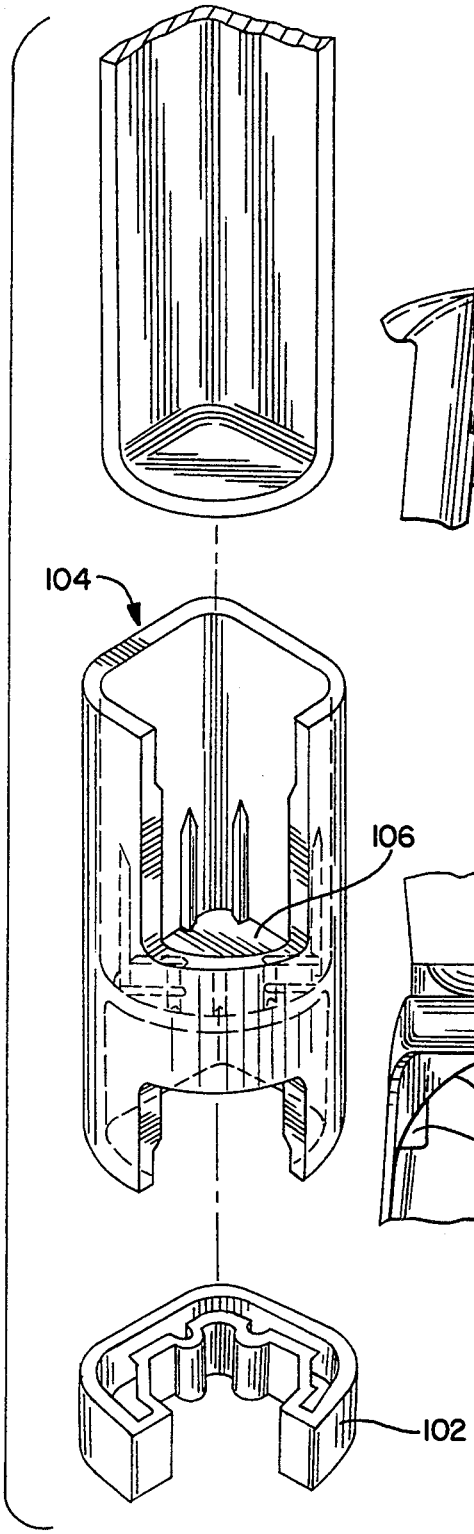
FIG. 7 is an exploded view of a chair leg, and a leg extension including an extender and a foot piece.

As shown in FIG. 7, leg extensions 100 including a tip or foot piece 102 and an extender 104 can be provided to simply and easily enable height adjustment of the chair. Four leg extensions 100, one for each leg of the chair are provided. The leg extension is preferably designed so that it can fit any of the four legs. Accordingly, the inside cross-section of the extender 104 conforms with the outside chair leg cross-section.

To raise the height of the chair, the extender 104 is slid over the feet 46 and 56 and their respective legs. A dividing platform 106 is provided on the internal perimeter of each leg extender 104 against which the feet 46 and 56 and thus the chair legs are supported. The dividing platform 106 is located near one end of the leg extender 104 so that two different vertical adjustments are possible depending into which end of the extender 104 the chair leg is inserted. For example, if the leg extender 104 is six inches long and the dividing platform 106 is two inches from one end, vertical adjustment may be two inches or four inches depending into which side of the extender 106 the foot 46 and 56 of the chair leg is inserted. When inserted into the extender 104, the feet 46 and 56 of the chair legs rest on the horizontal dividing platform 106 of the leg extender 104. The foot piece 102 can slidably engage the bottom or the portion of the extender 104 contacting the floor to provide a stable surface.

Figure 2:
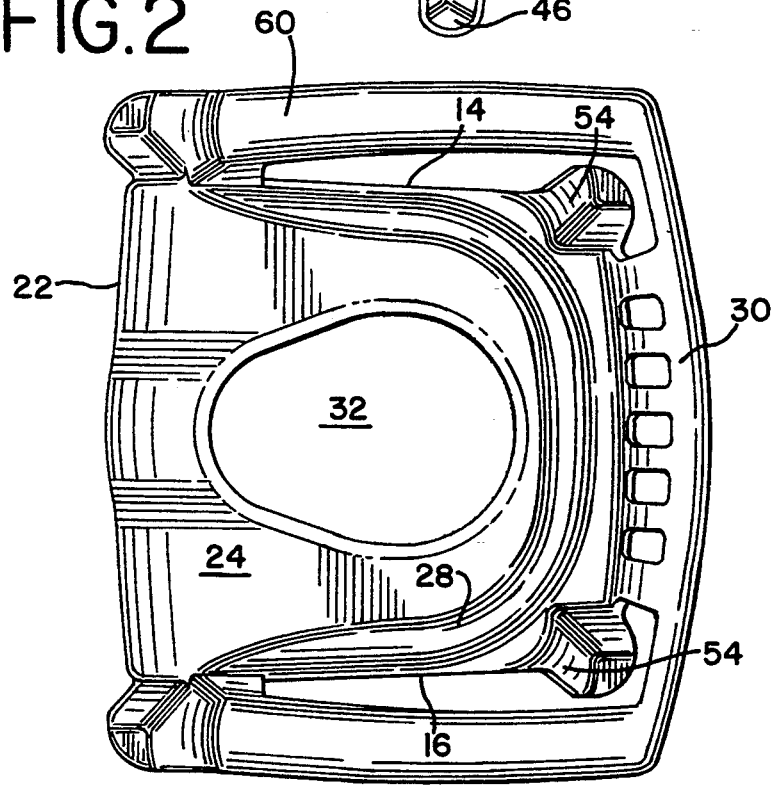
FIG. 2 is a top plan view of the commode chair shown in FIG. 1.

As noted above, the backrest 30 is integrally formed with and extends substantially vertically upward from the rear 18 of the seat. Preferably, the width of the backrest 30 is less than the width from the lateral side 14 to the lateral side 16 of the seat 12 so that the rear legs 50 are subtended by the area defined by the backrest 30, the armrests 60, and the front edge 22 of the seat, as best seen in FIG. 2. In addition, the distance between the distal end or outermost edges of the curved flanges 54 is about equal to the width of the seat. Preferably, each distal end or outermost edge of the curved flanges 54 lies in the same plane as each lateral side 14 and 16. Of course, the backrest 30 may be of any suitable height. The backrest 30 may also have a solid, slatted, or other known pattern dictated by, among other things, comfort, manufacturing, and aesthetic considerations.

Armrests 60 are integrally formed and are continuous with the front legs 40 and backrest 30 to form a chair frame and to define an open area between the underside of the armrest 60, the lateral sides 14 and 16 of the seat 12, and the backrest 30. It will be appreciated that the armrests 60 at the front of the chair are continuous with the front legs 40 to define the curved flange 44. Armrests 60 are also formed with the backrest 30 near its top and in that location the armrests 60 are generally in line with the backrest 30 prior to curving downwardly and forwardly toward the front of the chair. Thus, it will be appreciated that the armrests 60 extend outwardly from the lateral sides 14 and 16 of the seat and do not overhang the lateral sides. With this configuration the armrests 60 lie in the same plane as the front legs 40.

The top surface 62 of the armrests 60 may be arched to provide a crown or may have a substantially flat top surface 62. In either case the top surface 62 provides a stable surface upon which the user can place their hands when rising out of or sitting down on the chair 10.

The armrests 60 are preferably inclined downwardly to the rear of the chair 10 so that the vertical elevation of the armrests 60 at the chair front is higher than the vertical elevation of the armrests 60 at the rear of the chair. When using the commode, the raised front edge of the armrest provides a surface against which the person can support oneself while sitting down or standing up. This arm construction enables a person to enter and exit the chair more easily with a minimum degree of knee bending.

An important feature is that the seat 12 is strong and durable but is not uncomfortable. To contribute to the strength and durability, the underside 26 of the seat is provided with a plurality of ribs that includes at least one front rib 70, a first lateral rib 74, a second lateral rib 78, and at least one rear rib 82.

Preferably, a plurality of gussets are also provided to enhance the stability and durability of the seat. The gussets include at least one gusset 72 that intersects the front rib 70, at least one gusset 76 to intersect the lateral rib 74, and at least one gusset 80 to intersect the lateral rib 78. Although the gussets can intersect the ribs at any desirable angle, preferably the gussets intersect the ribs at a substantially right angle.

Figure 3:
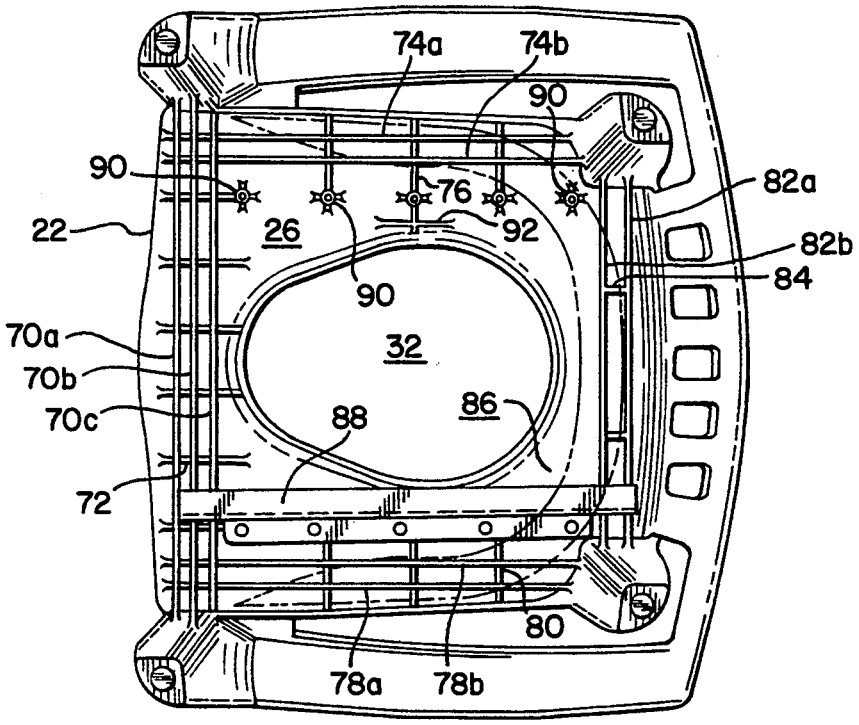
FIG. 3 is a bottom plan view of the commode chair with one embodiment of a single bucket rail shown and the bucket removed.

As best seen in FIG. 3, the underside 26 of the seat 12 is provided with at least one front rib 70 substantially adjacent and parallel to the front edge 22 of the seat 12. The front rib 70 extends from one front leg to the other and is intersected by at least one gusset 72. The gusset 72 extends from near the front edge 22 toward the rear 18 of the seat.

Preferably, more than one front rib 70 is provided more preferably, three front ribs **70*a–c* are provided. When three front ribs 70*a–c* are provided, the two ribs 70*a* and 70*b* nearest the front edge 22 of the seat 12, preferably extend from one front leg to the other more preferably the ribs 70*a* and 70*b* join the flat flange 42 of one leg 40 to the flat flange 42 of the other leg 40. In this embodiment, the third rib 70*c* extends from the first side 14 to the second side 16 of the seat 12**.

Spaced apart front gussets 72 that intersect the front ribs can also be provided. Preferably, when three front ribs 70 are provided, six substantially equally spaced apart gussets are provided. It is to be understood, however, that any number of ribs and gussets can be provided.

The underside 26 also includes at least one lateral rib 74 located adjacent and parallel to the first lateral side 14 of the seat 12. The rib 74 extends from the front of the seat, preferably the front edge 22, to the rear leg 50, preferably to the curved flange 54. At least one gusset 76 intersects the lateral rib 74 and extends from the first lateral side 14 toward the second lateral side 16. Preferably, two lateral ribs **74*a* and 74*b* that extend from the front of the seat, preferably the front edge 22, to the rear leg 50, preferably to the curved flange 54 are provided. In this embodiment, three substantially equally spaced gussets 76 that intersect the ribs 74** are provided. Of course, it is understood that any number of gussets and ribs can be provided.

The second lateral side 16 is desirably symmetrical with the first lateral side 14. Accordingly, the underside 26 also includes at least one lateral rib 78 located adjacent and parallel to the second side 16 of the seat 12. The rib 78 extends from the front of the seat, preferably the front edge 22, to the rear leg 50 preferably the curved flange 54. At least one gusset 80 intersects the lateral ribs 78 and extends from the second lateral side 16 toward the first lateral side 14. Preferably, two lateral ribs **78*a* and 78*b* are provided that extend from the front of the seat, preferably the front edge 22, to the rear leg 50, preferably to the curved flange 54. In this embodiment, three substantially equally spaced gussets 80 that intersect the lateral ribs 78*a* and 78*b*** are provided. Of course, it is understood that any number of gussets and ribs can be provided.

At least one rear rib 82 located adjacent and substantially parallel to the rear 18 is provided. The rib 82 extends from one rear leg 50 to the other rear leg, particularly from one flat flange 52 to the other flat flange 52. Preferably, two rear ribs **82*a* and 82*b*** are provided.

Where two rear ribs 82 are provided, at least one, preferably two, rear gussets 84 are provided to join the rear ribs 82. By providing this network of ribs and gussets the strength and durability of the seat 12 and chair 10 is enhanced.

Preferably, the underside of the seat 26 is also provided with two handle engaging ribs 92. Each engaging rib 92 is parallel to lateral sides 14 and 16 and adjacent the central opening 32. Each rib 92 is located between the respective lateral ribs 74 and 78 and the perimeter of the central opening 32 which will be more fully explained below.

As noted above, the chair 10 of the present invention is not uncomfortable even when the person must remain sitting for an extended period of time. The sculpting and contouring of the top surface 24 of the seat aids in providing comfort to the user. Also, the underside 26 of the seat 12, as shown in FIG. 3, has a slightly resilient transition zone 86 that partially borders the central opening 32 and is free from subjacent ribs and gussets. As best seen in FIG. 3, that the transition zone 86 borders the central opening 32 along about the rear one-third of the central opening 32.

In addition, gussets 72, 80, 84 are tapered at each of their ends. Accordingly, as the gussets extend toward the central opening 32 their height decreases so that when a person sits on the chair a slight downward deflection can occur to aid in the comfort of the seat.

Figure 4:
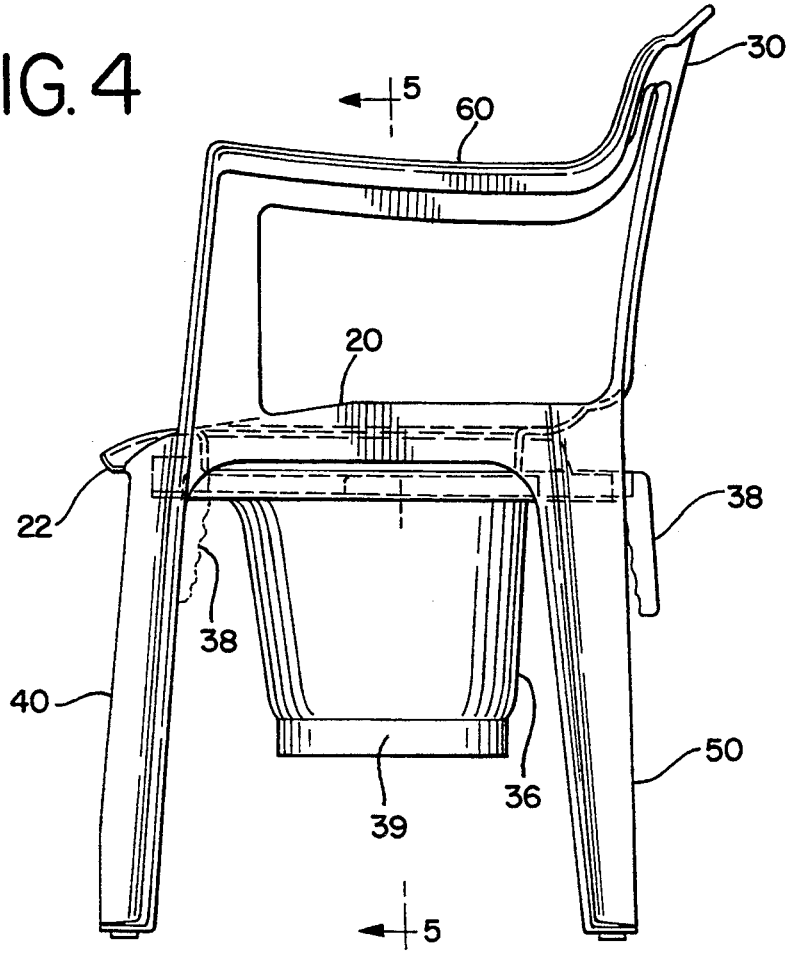
FIG. 4 is a side schematic view of the commode chair shown in FIG. 1 with the bucket in position and with the handle shown extending to the rear and also shown in shadow extending to the front.
Figure 5:
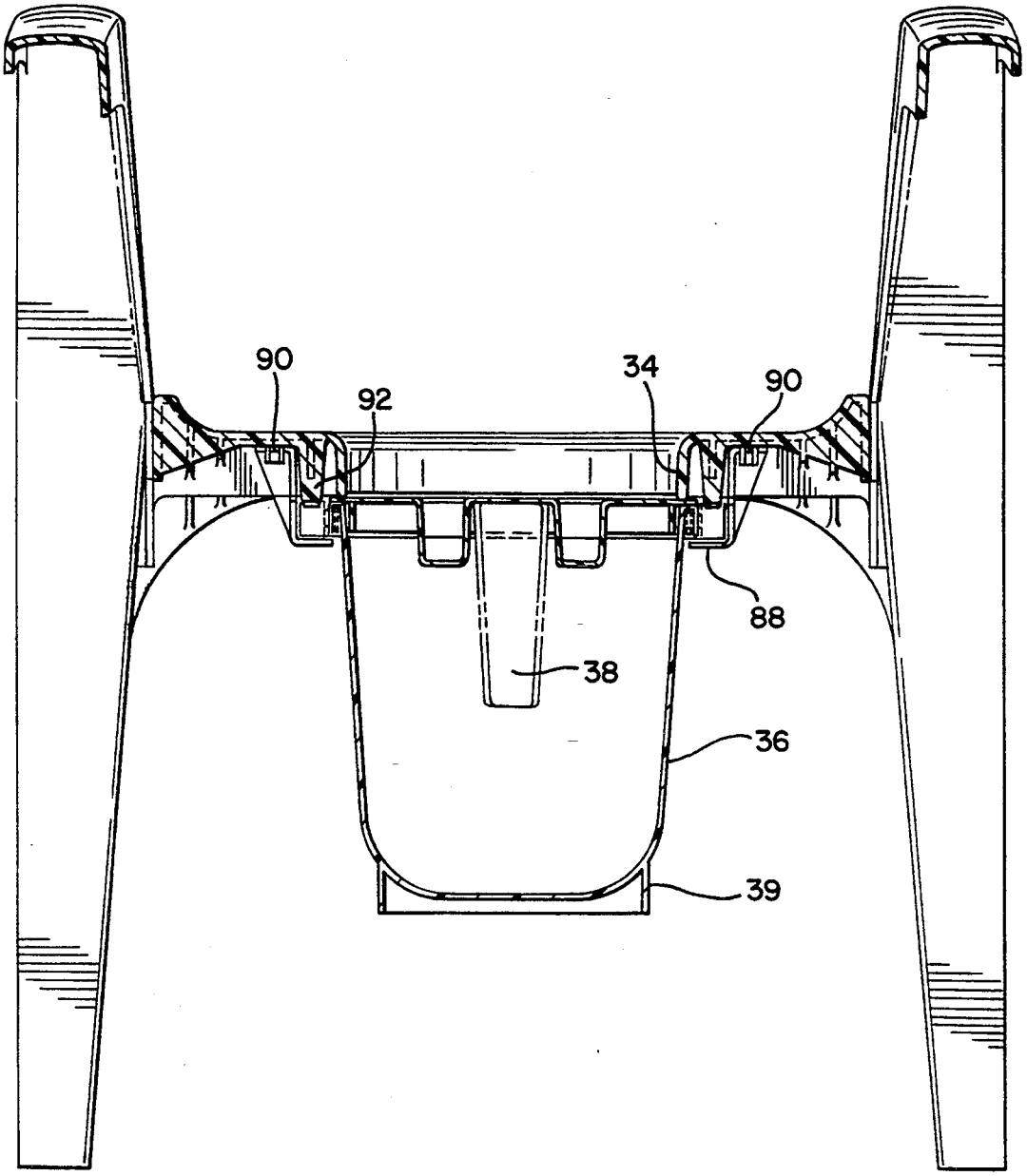
FIG. 5 is a cross-section view of the commode chair of FIG. 4 along line 5—5.
Figure 6:
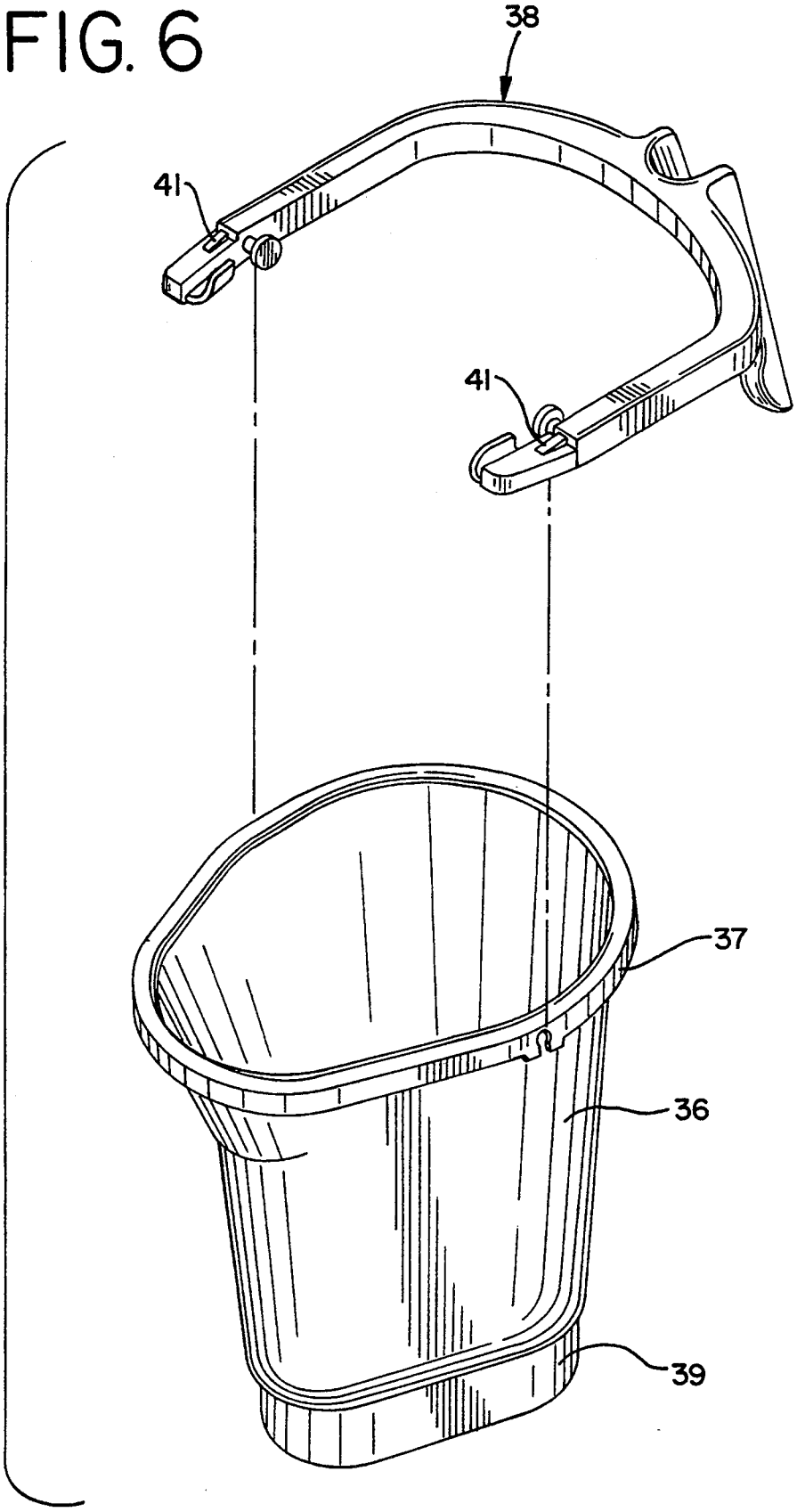
FIG. 6 is an exploded view of the bucket and handle assembly.

A commode bucket 36 having an open top as shown in FIGS. 4, 5, and 6 is suspended from the underside 26 of the seat 12. Preferably, the bucket 36 is supported by rails 88 provided on the underside 26 of the seat 12. Of course, the rails 88 are spaced from the underside 26 of the seat to provide an area to slidably insert and remove the bucket 36.

The rails 88 can be provided on the underside 26 of the seat in may different ways. In one embodiment, at least two bosses 90 (FIG. 3) are integrally molded with the underside 26 of the seat. At least one boss 90 is located between the lateral side 14 and the central opening 32 and at least another boss 90 is located between the lateral side 16 and the central opening 32. A pair of rails 88 are provided, each having a hole to receive the boss 90, so that the rail 88 is secured to the underside 26 of the seat.

In another embodiment, two sets of spaced apart bosses 90 are provided with each set integrally molded in a line with the underside 26 of the seat. Each line of bosses 90 lies in a plane parallel to the lateral sides 14 and 16 of the seat 12 and between the lateral ribs 74 and 78 and the engaging ribs 92. Of course it will be appreciated that any number of bosses 90 can be provided. Preferably, the bosses 90 extend the full length of the central opening 12.

In this embodiment, a pair of rails 88, preferably molded from plastic, with a number of holes are provided so that when the bosses 90 engage the holes, the rails 88 are securely held to the underside 26 of the seat. The number of rail holes correspond to the number of bosses 90. Preferably, the rails 88 are secured to the bosses by heat staking.

In another embodiment, the rails 88 are integrally molded on the underside 26 of the seat 12 parallel to the lateral sides. In this embodiment, one rail 88 is located on one side of and adjacent to the central opening. The other rail 88 is located on the other side of and adjacent to the central opening.

The bucket 36 preferably has an outer rim 37 overhanging the open top of the bucket 36. The bucket 36 rests on and depends from the rails 88 provided on the underside 26 of the seat. The open top of the bucket conforms to the central opening of the seat, i.e., preferably narrower in the front than in the back. As noted above, the central opening 32 has a downwardly extending lip 34 so that when the bucket 36 is in place, the possibility of waste escaping the bucket 36 is minimized. A commode bucket liner may also be provided to hang downwardly into the commode bucket 36. The front wall of the bucket may also be angled more sharply in the front than in the sides and back to ensure that the possibility of waste escaping is minimized. In addition, a false foot 39 can be provided on the bottom of the bucket 36 so that the inside bottom of the bucket 36 can be smooth and free of corners, while the outside bottom of the bucket is able to rest (on foot 39) on the floor or a similar flat surface.

As best seen in FIG. 6, a handle 38 can be provided to grasp the bucket from either the rear or the front of the chair so that the bucket 36 can be slidably removed from under the central opening 32 and emptied. The handle 38 is provided with a leaf spring 41 on its upper surface which will biasly act against the engaging rib 92 so that the bucket 36 will be properly positioned below the central opening provided in the seat 26. Uniquely, the leaf spring 41 is located in such a position and the length of the engaging rib 92 is such that it cooperates with the leaf spring 41 so that the bucket 36 will be properly positioned regardless of whether the handle 38 is facing the front or the rear of the chair when the bucket 36 is mounted.

Alternatively, the bucket 36 may have a handle 38 molded integrally with the bucket 36 so that when the bucket is suspended in position the handle 38 extends toward the rear of the chair. Of course, the handle 38 may be integrally molded so that when the bucket 36 is suspended in position, the handle 38 extends toward the front of the chair. With either type of a handle, only one hand is required to grasp, slidably remove the bucket, and empty it.

An important feature of the present invention is that the chairs 10 are stackable. The stacking height is largely determined by the height of the ribs and gussets since they will contact the upper side of the seat 26 of the underlying chair.

Figure 8:
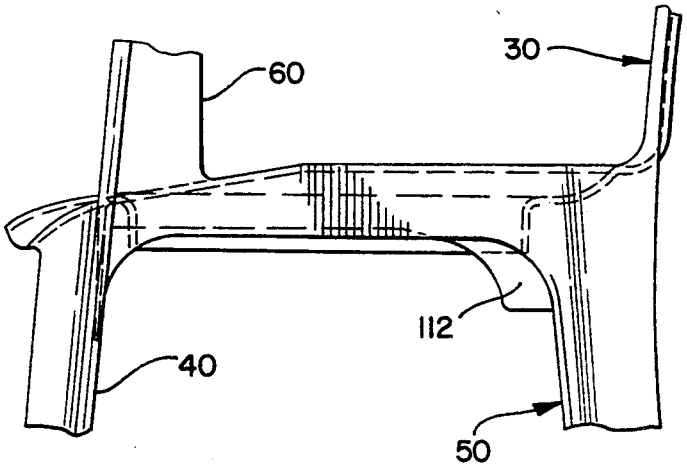
FIG. 8 is a front view of a portion of one embodiment of the commode chair of the present invention with the rails and the bucket removed to show front stacking ribs.

In one embodiment, as best seen in FIG. 8, two downwardly extending front stacking ribs 110 are provided. The first front stacking rib 110 is coextensive with a front leg 40 and a front rib 70. The second front stacking rib 110 is coextensive with the other front leg 40 and a front rib 70, preferably the same front rib 70 that the first stacking rib 110 is coextensive with. When one chair 10 is stacked on top of another, the stacking ribs 110 of the top chair substantially abut the upper side of the seat 24 of the subjacent chair 10. By providing a pair of front stacking ribs 110, the stacking angle of the stacked chairs can be fixed from about 0 to about 5 degrees from the vertical. Where three front ribs 70*a–c* are provided, each stacking rib 110 is coextensive with front leg 40, preferably the flat flange 42, and the inner most front rib 70*c*.

Figure 9:
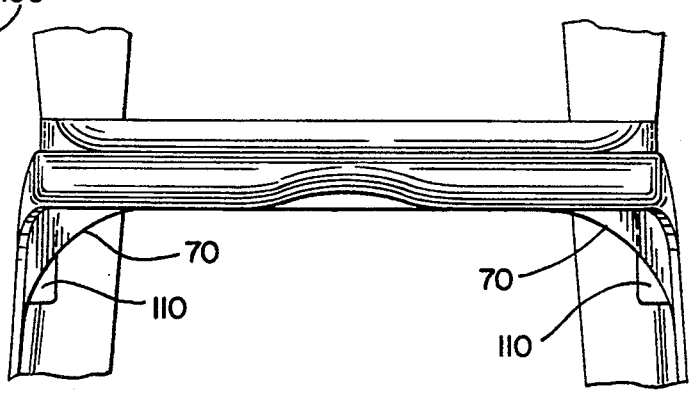
FIG. 9 is a side view of a portion of one embodiment of the commode chair of the present invention with the rails and the bucket removed to show a rear stacking rib.

In another embodiment, as best seen in FIG. 9, two downwardly extending rear stacking ribs 112 are provided. The first rear stacking rib 112 is coextensive with a rear leg 50 and a lateral rib 74. The second rear stacking rib 112 is coextensive with the other rear leg 50 and a lateral rib 78. When one chair 10 is stacked on top of another, the stacking ribs 112 of the top chair substantially abut the upper side of the seat 24 of the subjacent chair 10. By providing a pair of rear stacking ribs 112, the stacking angle of the stacked chairs can be fixed from about 0 to about 5 degrees from the vertical.

Where two lateral ribs 74 are provided, the first stacking rib 112 is coextensive with the rear leg 50, preferably the curved flange 54, and the outer most lateral rib 74*a*. Where two lateral ribs 78 are provided, the second stacking rib 112 is coextensive with the other rear leg 50, preferably the curved flange 54, and the outer most lateral rib 78*a*.

In the most preferred embodiment, two front stacking ribs 110 and two rear stacking ribs 112, as described above, are provided. In this embodiment, when a chair 10 is stacked on top of another, the front stacking ribs 110 and the rear stacking ribs 112 of the top chair substantially abut the upper side of the seat 24 of the subjacent chair 10. Thus, the stacking angle is fixed at from about 0 to about 5 degrees from the vertical.

Advantageously, when one chair is stacked onto another, the rear legs 50 of the top chair extend through the open sides created by the armrests 60 so that the curved flanges 44 and 54 of the top chair mate with the corresponding curved flanges 44 and 54 of the bottom chair. Thus, the space taken up by the stacked chairs is minimized. It is understood that two or more chairs may be stacked.

Since the chair of the present invention has an unitary integrally molded plastic construction, it is easily cleaned so that it can be maintained in a sanitary condition. All surfaces and edges are designed to allow the chair to be wiped easily with a cloth and small crevices are kept to a minimum. Importantly, since the chair is integrally molded of plastic with no metal parts, it can be easily hosed or sprayed down.

Frail people need to be able to support their weight with their arms as they lower themselves into a seat and push when they stand up. It is easier to sit down or stand up from the present commode chair because the distance of descent and ascent is limited. In addition, the armrests are advantageously raised in the front (See FIG. 4, for example) so that they are within finger tip reach for a person standing erect. A person is able to back up to the chair and feel for the arms without bending over. They are then able to take up their weight with their arms before they have descended to a point where the legs and knees are under most stress and most inclined to collapse. The front or leading edge 22 is preferably rounded to minimize the occurrence of numbness in the user's legs.

Because the commode chair of the present invention can be subjected to use by a large number of people over a number of years, it is desirable that the chair be able to withstand the expected long term repetitive use. Oftentimes, when disabled or elderly persons use the chair, they fall or are dropped into the seat rather than being gently lowered. Thus, the seat, and in particular, the area of the seat bordering the central opening must be able to withstand the forces resulting from a person dropping onto the seat. Also, when the person sitting on the seat wishes to get off of the chair, they will push downward on the armrests in order to lift themselves out of the chair. Consequently, it is desirable that the chair be able to withstand each of these varying forces over the anticipated period of use.

Figure 10:
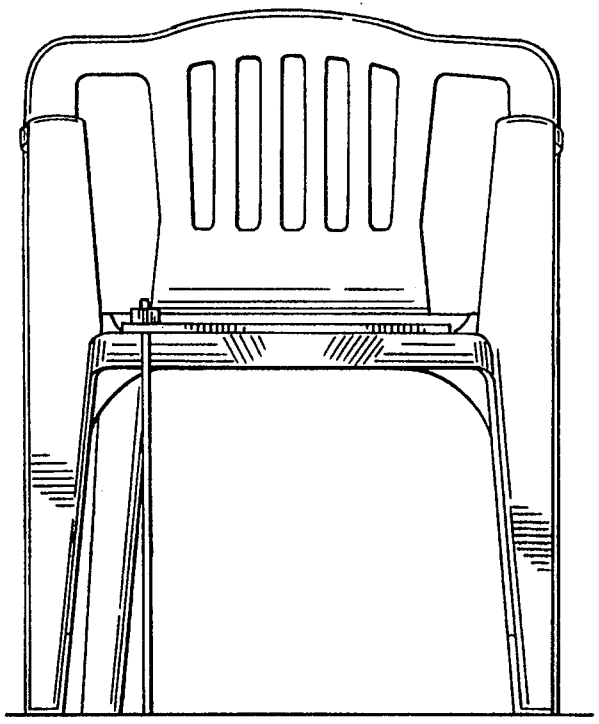
FIG. 10 is a schematic perspective view of the commode chair of FIG. 1, showing the arm strength test.

As noted above, the armrests should be able to withstand the stresses applied by the user when getting into and out of the chair. Accordingly, a test, shown schematically in FIG. 10, can be performed by applying a vertical 200 pound load through a 5 inch long area at the armrest horizontal center area. The load is held for one minute to stabilize deflection. A second test can be conducted by applying a 400 pound load through a 5 inch long area at the center of a horizontal member which spans across both armrests at the center area of the armrests.

Figure 11:
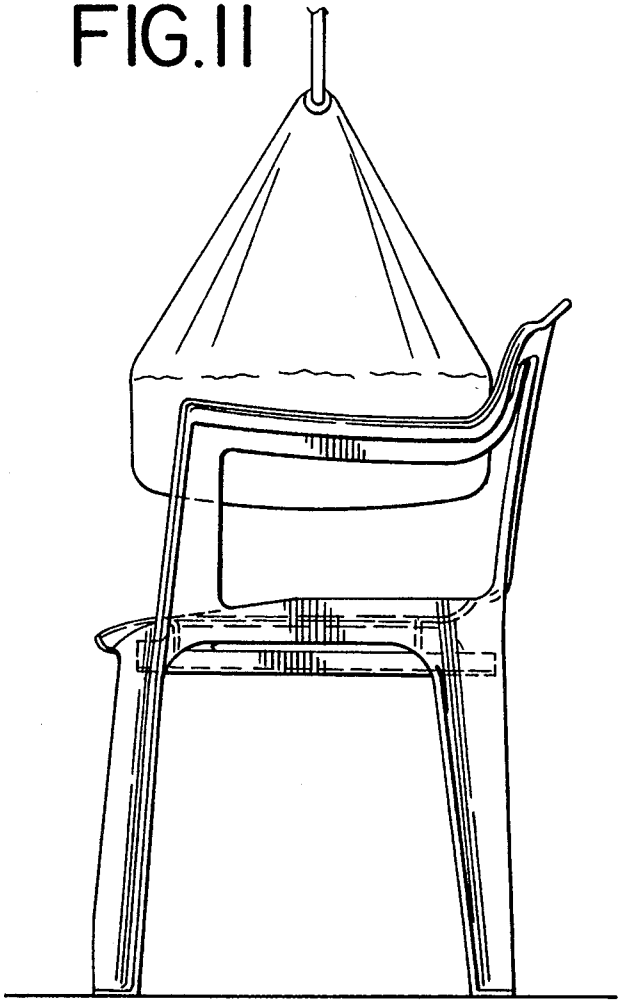
FIG. 11 is a schematic prospective view of the commode chair of FIG. 1, showing the seat impact test.

Two different tests to ensure the durability of the seat can be performed. The first test, shown schematically in FIG. 11, evaluates the ability of the chair to withstand stresses that occur as the result of heavy impacts on the chair seat. The test is performed by dropping a bag of sand onto the center of the seat from a free fall height of about 5 to about 16 inches. The base has a base diameter of sixteen inches and weighs 225 pounds. After the bag is dropped it is removed and the chair is inspected for distortions or breakage.

Figure 12:
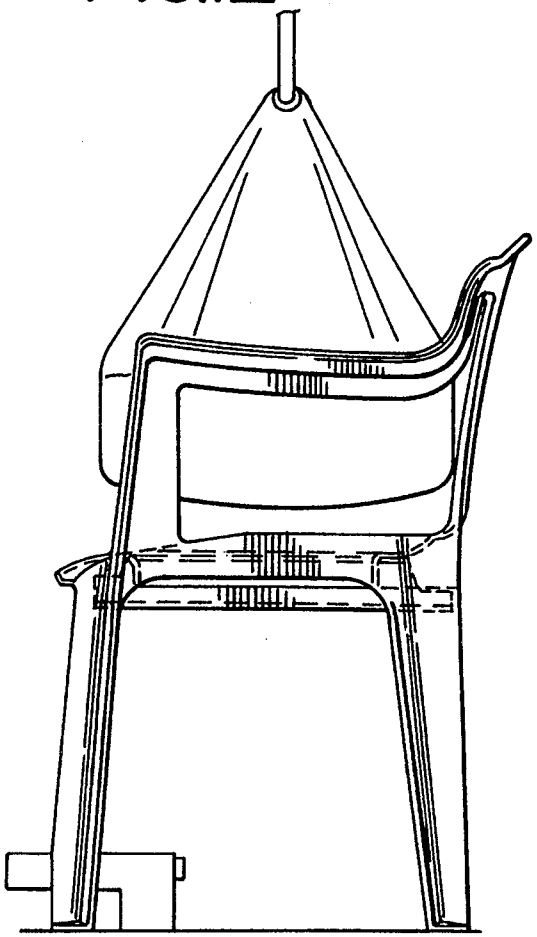
FIG. 12 is a schematic prospective view of the commode chair of FIG. 1, showing the cyclic seating impact test.

The second test, shown schematically in FIG. 12, evaluates the effect of a repetitious load applied to the seat. The test is performed by dropping a bag onto the seat of the chair from a free fall height of two inches at 55 cycles per minute. The bag has a sixteen inch diameter and weighs 225 pounds. The load is dropped for at least 50,000 cycles.

The chair of the present invention is designed to be stable, durable, comfortable and with aesthetics in mind so that it is not unsightly. It should be understood, however, that a wide range of changes and modifications can be made to the embodiments described above. It is therefore intended that the foregoing description illustrates rather than limits this invention, and that it is the following claims, including all equivalents, which define this invention.

We claim:

1. An unitary stackable commode chair comprising:

a. a generally horizontal seat with a top surface, an underside, a front, a first and a second lateral side, and a rear terminating in a substantially vertical backrest extending upward, the seat having a central opening;

b. two front legs extending downward from the front of the seat;

c. two rear legs extending downward from the rear of the seat;

d. armrests integrally formed with the seat and front legs at one end and the backrest at the other end, the armrests joining each of the two front legs to the backrest;

e. the seat further having a plurality of subjacent ribs comprising i. at least one front rib adjacent and substantially parallel to the front of the seat and joining the two front legs, ii. at least one first lateral rib adjacent to and substantially parallel to the first lateral side and extending from the front of the seat to the rear leg, iii. at least one second lateral rib adjacent to and substantially parallel to the second lateral side and extending from the front of the seat to the rear leg, iv. at least one rear rib adjacent and substantially parallel to the rear of the seat and joining the two rear legs; and, f. the seat further having a slightly resilient transition zone partially bordering the central opening and being free from subjacent ribs and gussets, with the seat being able to withstand an impact force of about 225 pounds at a height from about 5 to about 16 inches; and, g. at least one stacking rib extending downward from the underside of the seat and being coextensive with one of the front and rear legs.

2. The unitary stackable commode chair of claim 1, wherein the seat has a front edge that is curved downward and adapted to receive the upper leg portions of an occupant of the chair.

3. The unitary stackable commode chair of claim 1, wherein the top surface of the seat has an upwardly curved portion along the rear and a portion of the sides.

4. The unitary stackable commode chair of claim 1, wherein the vertical elevation of the armrests is greater at the chair front than the rear.

5. The unitary stackable commode chair of claim 1, wherein the top surface of the armrests is substantially flat.

6. The unitary stackable commode chair of claim 1 further having rails provided on the underside of the seat capable of supporting a commode bucket located under the central opening.

7. The unitary stackable commode chair of claim 6 wherein the rails are integrally molded on the underside of the seat.

8. The unitary stackable commode chair of claim 1, further having:

a. two lines of spaced apart bosses integrally molded with the underside of the seat, each line of bosses being parallel to the lateral sides of the seat and located on either side of the central opening; and b. two rails with holes corresponding to the bosses such that when the bosses receive the holes, each rail is secured to and spaced from the underside of the seat.

9. The unitary stackable commode chair of claim 8, further having a removable commode bucket supported by the rails and depending downwardly from the central opening of the seat.

10. The unitary stackable commode chair of claim 1 further having two downwardly extending front stacking ribs, the first stacking rib being coextensive with one front leg and a front rib, the second stacking rib being coextensive with the other front leg and a front rib.

11. The unitary stackable commode chair of claim 1 further having two downwardly extending rear stacking ribs, the first stacking rib coextensive with one rear leg and a first lateral rib and the other rib coextensive with the other rear leg and a second lateral rib.

12. The unitary stackable commode chair of claim 1, wherein the armrests can withstand the force of a vertical 200 pound load applied through a 5 inch wide area at the horizontal center area of the armrest.

13. The unitary stackable commode chair of claim 1, wherein the seat can withstand the force of a bag having a 16 inch diameter base and weighing 125 pounds that is dropped from a free fall height of 2 inches at a rate of 55 cycles per minute for at least 50,000 cycles.

14. The unitary stackable commode chair of claim 1, further comprising leg extensions including a leg extender wherein the leg extender contains a divider platform such that when a leg extension is inserted onto a chair leg the height of the chair is raised to either of two differing heights.

15. An unitary stackable commode chair comprising:

a. a generally horizontal seat with a top surface, an underside, a front, a first and a second lateral side, and a rear terminating in a substantially vertical backrest extending upward, the seat having a central opening;

b. two front legs extending downward from the front of the seat, the legs being shaped substantially as angles open on the sides and toward the front and comprising a flat flange and a curved flange, the flat flange lying in substantially the same plane as the lateral side of the seat, and the curved flange lying at a substantially right angle to the flat flanges;

c. two rear legs extending downward from the rear of the seat, the legs being shaped substantially as angles open on the sides and toward the front and comprising a flat flange and a curved flange, the flat flange lying in a plane substantially parallel to the plane of the lateral side of the seat, and the curved flange lying at a substantially right angle to the flat flanges;

d. armrests integrally formed with the seat and front legs at one end and the backrest at the other end, the armrests joining each of the two front legs to the backrest;

e. a plurality of subjacent ribs and gussets comprising i. at least one front rib adjacent and substantially parallel to the front of the seat and joining the two front legs, the front rib being intersected by at least one gusset, ii. at least two first lateral ribs adjacent to and substantially parallel to the first lateral side and extending from the front of the seat to the rear leg, the lateral ribs being intersected by at least one gusset, iii. at least two second lateral ribs adjacent to and substantially parallel to the second lateral side and extending from the front of the seat to the rear leg, the lateral ribs being intersected by at least one gusset, iv. at least one rear rib adjacent and substantially parallel to the rear of the seat and joining the two rear legs; and, f. the seat further having a slightly resilient transition zone partially bordering the central opening and being free from subjacent ribs and gussets, with the seat being able to withstand an impact force of 225 pounds at a height from about 5 to about 16 inches; and, g. at least one stacking rib extending downward from the underside of the seat and being coextensive with one of the front and rear legs.

16. The unitary stackable commode chair of claim 15, wherein the seat has a front edge that is curved downward and adapted to receive the upper leg portions of an occupant of the chair.

17. The unitary stackable commode chair of claim 15, wherein the top surface of the seat has an upwardly curved portion along the rear and a portion of the sides.

18. The unitary stackable commode chair of claim 15, wherein the vertical elevation of the armrests is greater at the chair front than the rear.

19. The unitary stackable commode chair of claim 15, wherein the top surface of the armrests is substantially flat.

20. The unitary stackable commode chair of claim 15 further having rails provided on the underside of the seat to support a commode bucket located under the central opening.

21. The unitary stackable commode chair of claim 20, wherein the rails are integrally molded on the underside of the seat.

22. The unitary stackable commode chair of claim 15, further having a. a line of spaced apart bosses integrally molded with the underside of the seat, the bosses being parallel to the lateral sides of the seat and located on either side of and adjacent to the central opening; and, b. a pair of rails with holes corresponding to the bosses such that when the bosses receive the holes the rail is secured to and spaced from the underside of the seat.

23. The unitary stackable commode chair of claim 22, further having a removable commode bucket supported by the rails and depending downwardly from the central opening of the seat.

24. The unitary stackable commode chair of claim 15 further having two downwardly extending front stacking ribs, the first stacking rib being coextensive with one front leg and a front rib, the second stacking rib being coextensive with the other front leg and a front rib.

25. The unitary stackable commode chair of claim 15 further having two downwardly extending rear stacking ribs, the first stacking rib coextensive with one rear leg and a first lateral rib and the other rib coextensive with the other rear leg and a second lateral rib.

26. The unitary stackable commode chair of claim 15, wherein the armrests can withstand the force of a vertical 200 pound load applied through a 5 inch wide area at the horizonal center area of the armrest.

27. The unitary stackable commode chair of claim 15, wherein the seat can withstand the force of a bag having a 16 inch diameter base and weighing 125 pounds that is dropped from a free fall height of 2 inches at a rate of 55 cycles per minute for at least 50,000 cycles.

28. The unitary stackable commode chair of claim 15, further comprising leg extensions including a leg extender wherein the leg extender contains a divider platform such that when a leg extension is inserted onto a chair leg the height of the chair is raised to either of two differing heights.

29. An unitary stackable commode chair comprising:

a. a generally horizontal seat with top surface, an underside, a front, a first and a second lateral side, and a rear terminating in a substantially vertical backrest extending upward, the seat having a central opening;

b. two front legs integrally formed with and extending downward from the front of the seat, the legs being shaped substantially as angles open on the sides and toward the front and comprising a flat flange and a curved flange, the flat flange lying in substantially the same plane as the lateral side of the seat, and the curved flange lying at a substantially right angle to the flat flanges;

c. two rear legs integrally formed with and extending downward from the rear of the seat, the legs being shaped substantially as angles open on the sides and toward the front and comprising, a flat flange and a curved flange, the flat flanges lying in substantially the same plane as the lateral side of the seat, and the curved flange lying at a substantially right angle to the flat flange;

d. armrests integrally formed with the seat and front legs at one end and the backrest at the other end, the armrests joining each of the two front legs to the backrest;

e. a plurality of subjacent ribs and gussets comprising:

i. three front ribs adjacent and substantially parallel to the front of the seat, with two ribs joining the flat flanges of the two front legs and the third rib extending from the first lateral side to the second lateral side, the front ribs being intersected by six substantially equally spaced gussets, the gussets extending from the front of the seat toward the rear, ii. two lateral ribs adjacent and substantially parallel to the first lateral side and extending from the front of the seat to the curved flange of the rear leg, the lateral ribs being intersected by three substantially equally spaced gussets, the gussets extending from the first lateral side toward the central opening, iii. two lateral ribs adjacent and substantially parallel to the second lateral side and extending from the front of the seat to the curved flange of the rear leg, the lateral ribs being intersected by three substantially equally spaced gussets, the gussets extending from the second lateral side toward the central opening, iv. two rear ribs adjacent and substantially parallel to the rear of the seat and joining the flat flanges of the rear legs, the rear ribs being joined by two spaced apart gussets; and, f. the seat further having a slightly resilient transition zone partially bordering the central opening and being free from subjacent ribs add gussets, with the seat being able to withstand an impact force of 225 pounds at a height of from about 5 to about 16 inches; and, g. at least one stacking rib extending downward from the underside of the seat and being coextensive with one of the front and rear legs.

30. The unitary stackable commode chair of claim 29 further having rails provided on the underside of the seat to support a commode bucket located under the central opening.

31. The unitary stackable commode chair of claim 30 wherein the rails are integrally molded on the underside of the seat.

32. The unitary stackable commode chair of claim 30, further having a. a line of spaced apart bosses integrally molded with the underside of the seat, the bosses being parallel to the lateral sides of the seat and located on either side of and adjacent to the central opening; and, b. a pair of rails with holes corresponding to the bosses such that when the bosses receive the holes the rail is secured to and spaced from the underside of the seat.

33. The unitary stackable commode chair of claim 32, further having a removable commode bucket supported by the rails and depending downwardly from the central opening of the seat.

34. The unitary stackable commode chair of claim 29 further having two downwardly extending front stacking ribs, the first stacking rib being coextensive with one front leg and a front rib, the second stacking rib being coextensive with the other front leg and a front rib.

35. The unitary stackable commode chair of claim 29 further having two downwardly extending rear stacking ribs, the first stacking rib coextensive with one rear leg and a first lateral rib and the other rib coextensive with the other rear leg and a second lateral rib.

36. The unitary stackable commode chair of claim 29, wherein the armrests can withstand the force of a vertical 200 pound load applied through a 5 inch wide area at the horizonal center area of the armrest.

37. The unitary stackable commode chair of claim 29, wherein the seat can withstand the force of a bag having a 16 inch diameter base and weighing 125 pounds that is dropped from a free fall height of 2 inches at a rate of 55 cycles per minute for at least 50,000 cycles.

38. The unitary stackable commode chair of claim 29, further comprising leg extensions including a leg extender wherein the leg extender contains a divider platform such that when a leg extension is inserted onto a chair leg the height of the chair is raised to either of two differing heights.

* * * * *